US011805949B2

(12) United States Patent
Hata et al.

(10) Patent No.: US 11,805,949 B2
(45) Date of Patent: Nov. 7, 2023

(54) TOILET DEVICE

(71) Applicants: TOTO LTD., Kitakyushu (JP); DAIICHI KASEI CO., LTD., Shimotsuke (JP); YOKO INDUSTRY CO., LTD., Tokyo (JP)

(72) Inventors: Hiroki Hata, Kitakyushu (JP); Yuji Maruyama, Shimotsuke (JP); Maya Teraoka, Tokyo (JP); Haruki Suzuki, Shimotsuke (JP); Toshihiko Shimizu, Shimotsuke (JP)

(73) Assignees: TOTO LTD., Fukuoka (JP); DAIICHI KASEI CO., LTD., Tochigi (JP); YOKO INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 17/931,594

(22) Filed: Sep. 13, 2022

(65) Prior Publication Data

US 2023/0096767 A1 Mar. 30, 2023

(30) Foreign Application Priority Data

Sep. 28, 2021 (JP) ..... 2021-158241

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1
See application file for complete search history.

(56) References Cited

U.S. PATENT DOCUMENTS 7,293,297 B2 * 11/2007 Hayashi ..... A47K 13/10 4/246.1
2018/0199772 A1 * 7/2018 Minamiyama ..... A47K 13/105

FOREIGN PATENT DOCUMENTS

JP 2018-091459 A 6/2018
JP 2020-162696 A 10/2020

* cited by examiner

*Primary Examiner* — Christine J Skubinna
(74) *Attorney, Agent, or Firm* — PEARNE & GORDON LLP

(57) ABSTRACT

A toilet device includes an electric opening/closing unit configured to open and close at least one of a toilet seat or a toilet lid. The electric opening/closing unit includes a case, a motor, an output shaft, a transmission mechanism and a spring. The output shaft outputs a rotation of the motor to one of the toilet seat or the toilet lid. The transmission mechanism transmits the rotation of the motor to the output shaft. The spring is connected to the transmission mechanism and the output shaft. The spring urges the output shaft in a rotational direction of the output shaft. The transmission mechanism includes an engaging part engaging the spring. The engaging part engages an end part of the spring at the transmission mechanism side and restricts the end part from moving in a circumferential direction of the spring and from moving in a radial direction of the spring.

4 Claims, 7 Drawing Sheets

TOILET DEVICE

CROSS-REFERENCE TO RELATED APPLICATIONS

This application is based upon and claims the benefit of priority from Japanese Patent Application No. 2021-158241, filed on Sep. 28, 2021; the entire contents of which are incorporated herein by reference.

FIELD

Embodiments described herein relate generally to a toilet device.

BACKGROUND

There is a toilet device to which an electric opening/closing unit is mounted to electrically open and close at least one of a toilet seat or a toilet lid. In a known electric opening/closing unit, a coil spring urges the toilet lid and/or toilet seat in the rotational direction. The urging force of the coil spring can assist the opening and closing of the toilet seat and/or toilet lid.

SUMMARY

According to the embodiment, a toilet device includes an electric opening/closing unit configured to open and close at least one of a toilet seat or a toilet lid. The electric opening/closing unit includes a case, a motor, an output shaft, a transmission mechanism and a spring. The motor is housed in the case. The output shaft outputs a rotation of the motor to one of the toilet seat or the toilet lid. At least a part of the output shaft protrudes from the case. The transmission mechanism is housed in the case. The transmission mechanism transmits the rotation of the motor to the output shaft. The spring is housed in the case and is connected to the transmission mechanism and the output shaft. The spring includes a coil part including a wire wound into a spiral shape. The spring urges the output shaft in a rotational direction of the output shaft. The transmission mechanism includes an engaging part engaging the spring. The engaging part engages an end part of the spring at the transmission mechanism side and restricts the end part from moving in a circumferential direction of the spring and from moving in a radial direction of the spring.

DETAILED DESCRIPTION

Figure 1:
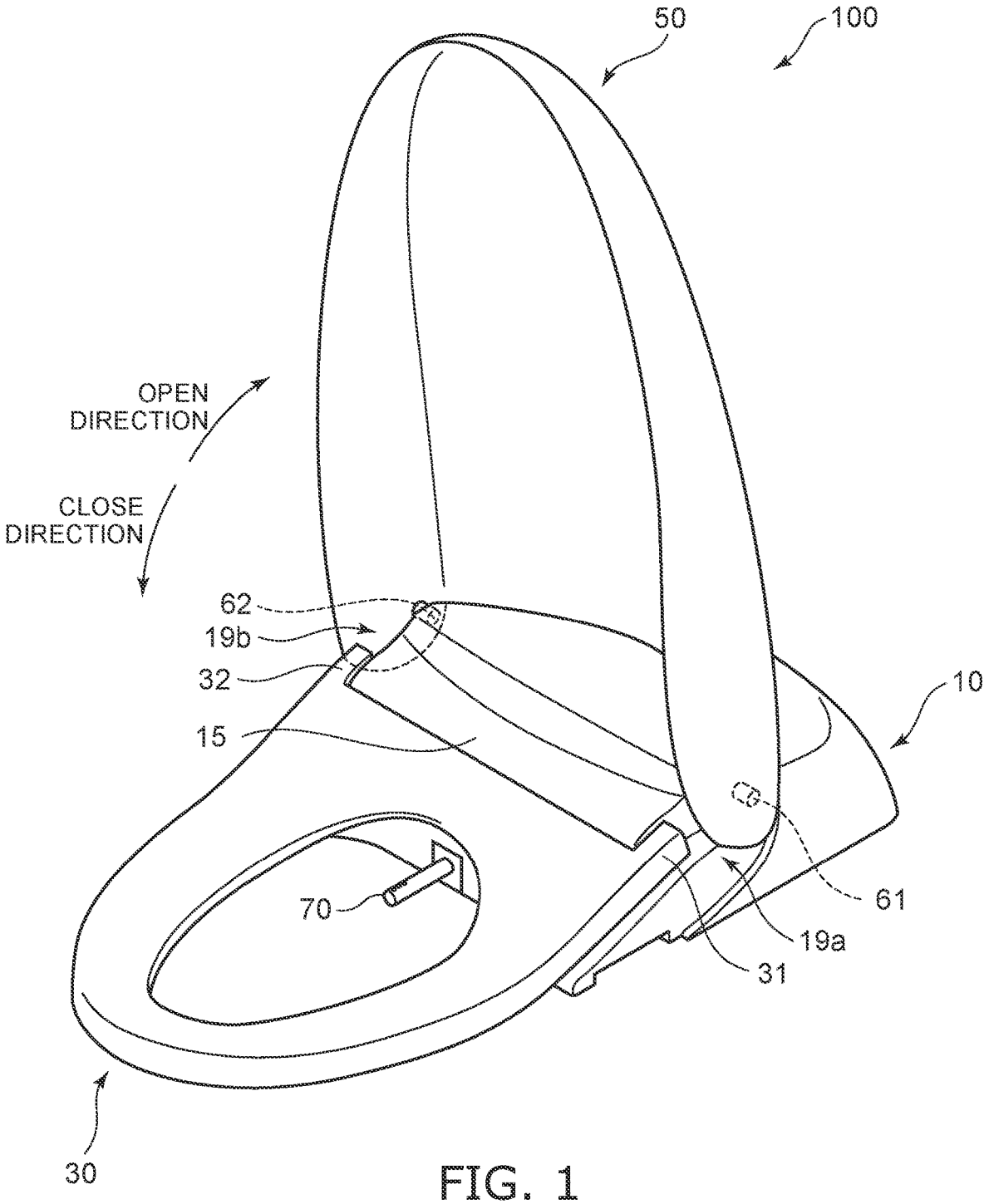
FIG. 1 is a perspective view illustrating a toilet device according to an embodiment.

A first invention is a toilet device including an electric opening/closing unit configured to open and close at least one of a toilet seat or a toilet lid; the electric opening/closing unit includes a case, a motor housed in the case, an output shaft outputting a rotation of the motor to one of the toilet seat or the toilet lid and of which at least a part protrudes from the case, a transmission mechanism that is housed in the case and transmits the rotation of the motor to the output shaft, and a spring that is housed in the case, is connected to the transmission mechanism and the output shaft, includes a coil part including a wire wound in a spiral shape, and urges the output shaft in a rotational direction of the output shaft; the transmission mechanism includes an engaging part engaging the spring; and the engaging part engages an end part of the spring at the transmission mechanism side and restricts the end part from moving in a circumferential direction of the spring and from moving in a radial direction of the spring.

According to the toilet device, the engaging part that is included in the transmission mechanism restricts the movement of the end part of the spring toward the circumferential direction. Thereby, the spring can be torqued as the output shaft rotates. Therefore, the spring can be wound and unwound. At this time, the engaging part that is included in the transmission mechanism can suppress the movement of the spring in the radial direction by restricting the movement of the end part of the spring in the radial direction. Contact of a part of the spring with a part of the electric opening/closing unit can be suppressed thereby, and frictional resistance can be suppressed.

A second invention is the toilet device of the first invention, wherein the engaging part includes a first part that is positioned inside the coil part and restricts a movement of a part of the spiral wire in the radial direction, and a second part that extends from the first part outward from inside the coil part and restricts a movement of the part of the wire in an axial direction.

According to the toilet device, the engaging part includes the second part; the movement of the spring in the axial direction can be suppressed thereby, even when the spring contracts in the axial direction; and the detachment of the spring from the transmission mechanism and the output shaft can be suppressed. The first part is positioned inside the coil part; and the second part extends from the first part outward from inside the coil part. An increase of the inner diameter of the case can be suppressed thereby, and the space inside the spring can be effectively used.

A third invention is the toilet device of the second invention, wherein the first part includes an arc-like part along an inner circumference of the coil part, and a part of the second part extends from one circumferential-direction end of the arc-like part to another end in the circumferential direction of the arc-like part.

According to the toilet device, the contact area between the engaging part and the spring can be increased, and the forces applied to the engaging part when the spring tends to move in the radial direction and the axial direction can be dispersed. The durability of the engaging part can be improved thereby.

A fourth invention is the toilet device of any one of the first to third inventions, wherein the output shaft includes a regulating part restricting a movement of the spring in the radial direction, and the regulating part is positioned inside the coil part.

According to the toilet device, the output shaft includes the regulating part; and the movement of the spring in the radial direction can be suppressed thereby, even at the output shaft side of the spring. For example, a reduction of the spring torque due to frictional resistance caused by contact between the spring and the case can be suppressed thereby, and an abnormal noise (a sliding noise) caused by the contact can be suppressed.

Exemplary embodiments will now be described with reference to the drawings. Similar components in the drawings are marked with like reference numerals; and a detailed description is omitted as appropriate.

FIG. 1 is a perspective view illustrating a toilet device according to an embodiment.

As illustrated in FIG. 1, the toilet device 100 (a toilet seat device) according to the embodiment includes a casing 10, a toilet seat 30 on which a user is seated, and a toilet lid 50 covering the toilet seat 30. The toilet seat 30 and the toilet lid 50 each are rotatably supported with respect to the casing 10. In other words, the toilet seat 30 and the toilet lid 50 each are pivotally supported to be openable and closeable. The state of FIG. 1 is the closed state (the lowered state) of the toilet seat 30 and the open state (the raised state) of the toilet lid 50. In the closed state, the toilet lid 50 covers the upper surfaces of the casing 10 and the toilet seat 30 from above.

A body wash functional unit that washes a human body private part (a "bottom" or the like) of the user sitting on the toilet seat 30, etc., are embedded inside the casing 10. For example, a washing nozzle 70, a control circuit that controls the operation of the washing nozzle 70, etc., are located inside the casing 10. When the user sits on the toilet seat 30, the washing nozzle 70 discharges wash water toward the private part of the user in a state of being advanced frontward from the interior of the casing 10. Various mechanisms such as a "warm air drying function" that dries the "bottom" or the like of the user sitting on the toilet seat 30 by blowing warm air, a "deodorizing unit", a "room heating unit", etc., may be provided in the casing 10 as appropriate.

As illustrated in FIG. 1, the casing 10 includes an upper surface 15. A pair of step parts (a first step part 19*a* and a second step part 19*b*) that is arranged in the lateral direction is provided at the front of the upper surface 15.

The toilet lid 50 includes a pair of toilet lid hinge parts (a first toilet lid hinge part 61 and a second toilet lid hinge part 62) arranged in the lateral direction. The toilet lid hinge parts are positioned inside the toilet lid. The first toilet lid hinge part 61 is located in the first step part 19*a*. The second toilet lid hinge part 62 is located in the second step part 19*b*. The toilet lid 50 is rotatably supported by the first toilet lid hinge part 61 and the second toilet lid hinge part 62. The toilet lid 50 is provided as necessary and is omissible.

The toilet seat 30 includes a pair of toilet seat hinge parts (a first toilet seat hinge part 31 and a second toilet seat hinge part 32) arranged in the lateral direction. The first toilet seat hinge part 31 is located in the first step part 19*a*. The second toilet seat hinge part 32 is located in the second step part 19*b*. The toilet seat 30 is rotatably supported by the first toilet seat hinge part 31 and the second toilet seat hinge part 32.

Figure 2:
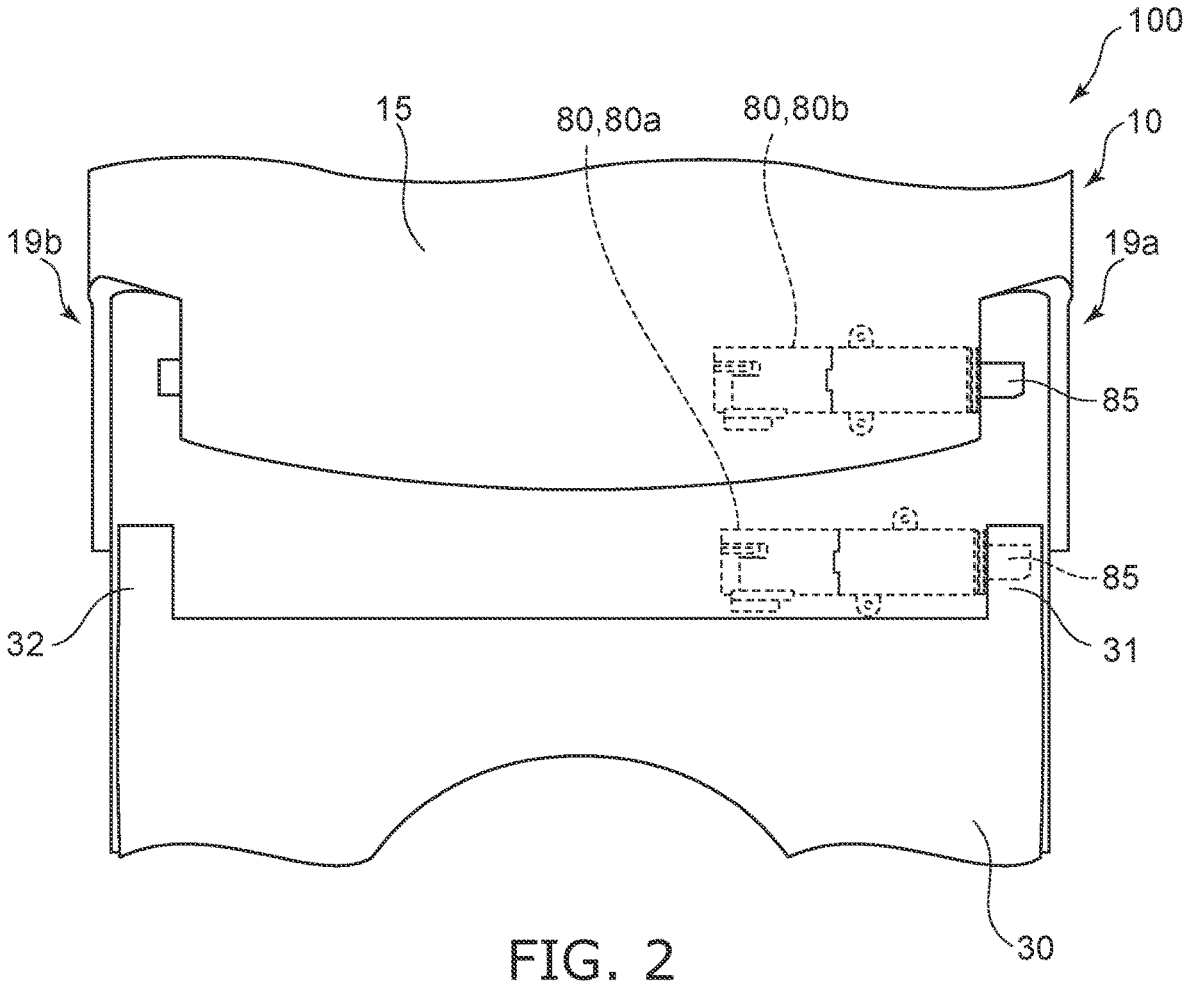
FIG. 2 is a plan view illustrating a part of the toilet device according to the embodiment.

FIG. 2 is a plan view illustrating a part of the toilet device according to the embodiment.

FIG. 2 shows the casing 10 when viewed from above with the toilet seat 30 in the closed state. The toilet lid 50 is not illustrated for easier viewing.

As illustrated in FIG. 2, the toilet device 100 includes an electric opening/closing unit 80 (an electric opening/closing device). The electric opening/closing unit 80 is configured to open and close at least one of the toilet seat 30 or the toilet lid 50. In the example, a toilet seat opening/closing unit 80*a* that is configured to open and close the toilet seat 30 and a toilet lid opening/closing unit 80*b* that is configured to open and close the toilet lid 50 are provided as the electric opening/closing units 80. At least a part of each electric opening/closing unit 80 is located inside the casing 10. The electric opening/closing unit 80 includes a driver such as a motor or the like and opens and closes the toilet seat 30 or the toilet lid 50 by the drive force of the driver. It is sufficient for the electric opening/closing unit 80 to include at least one of the toilet seat opening/closing unit 80*a* or the toilet lid opening/closing unit 80*b*. That is, one of the toilet seat opening/closing unit 80*a* or the toilet lid opening/closing unit 80*b* may be omitted.

For example, an output shaft 85 of the toilet seat opening/closing unit 80*a* protrudes from the side surface of the casing 10 at the first step part 19*a* and is directly or indirectly connected with the toilet seat 30. In the example, the output shaft 85 of the toilet seat opening/closing unit 80*a* engages the first toilet seat hinge part 31. The toilet seat opening/closing unit 80*a* rotates the toilet seat 30 by rotating the first toilet seat hinge part 31 by rotating the output shaft 85 with the torque of the motor. The toilet seat opening/closing unit 80*a* may be located at the second toilet seat hinge part 32 side.

Similarly, the output shaft 85 of the toilet lid opening/closing unit 80*b* protrudes from the side surface of the casing 10 at the first step part 19*a* and is directly or indirectly connected with the toilet lid 50. In the example, the output shaft 85 of the toilet lid opening/closing unit 80*b* engages the first toilet lid hinge part 61. The toilet lid opening/closing unit 80*b* rotates the toilet lid 50 by rotating the first toilet lid hinge part 61 by rotating the output shaft 85 with the torque of the motor. The toilet lid opening/closing unit 80*b* may be located at the second toilet lid hinge part 62 side.

Figure 3:
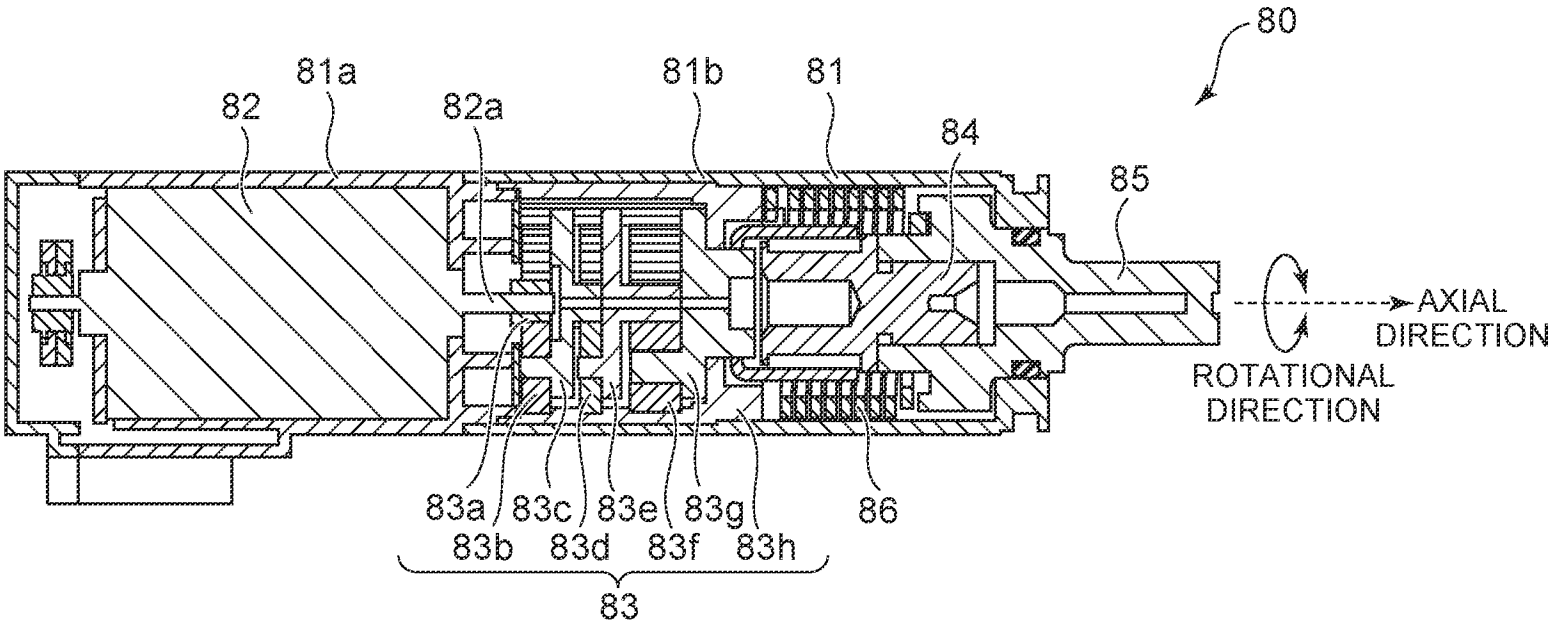
FIG. 3 is a cross-sectional view illustrating the electric opening/closing unit according to the embodiment.

FIG. 3 is a cross-sectional view illustrating the electric opening/closing unit according to the embodiment.

As illustrated in FIG. 3, the electric opening/closing unit 80 includes a case 81, a motor 82, a transmission mechanism 83, a shaft part 84, the output shaft 85, and a spring 86.

In the example, the case 81 includes a first case member 81*a* and a second case member 81*b*. The first case member 81*a* and the second case member 81*b* are combined to form the tubular case 81. Thus, the case 81 may be a combination of multiple members or may be formed from one member. The case 81 is fixed to the casing 10 by any fixing technique such as screws, bolts, etc.

The motor 82 is housed in the case 81. More specifically, at least a part of the motor 82 is housed in the first case member 81*a*; and a rotary shaft 82*a* of the motor 82 protrudes toward the second case member 81*b* side.

The transmission mechanism 83 is housed in the second case member 81*b* of the case 81. The transmission mechanism 83 is connected with the rotary shaft 82*a* of the motor 82 and directly or indirectly transmits the rotation of the motor 82 to the output shaft 85. In the example, the rotation of the motor 82 is transmitted to the output shaft 85 via the shaft part 84.

The transmission mechanism 83 is, for example, a speed reduction mechanism, and is a planetary gear mechanism in the example. More specifically, in the example, the transmission mechanism 83 includes a sun gear 83*a*, a planetary gear 83*b*, a planetary carrier 83*c* (a sun gear), a planetary gear 83*d*, a planetary carrier 83*e* (a sun gear), a planetary gear 83*f*, a planetary carrier 83*g*, and an internal gear 83*h*.

The internal gear 83*h* is tubular; and teeth that engage the planetary gears 83*b*, 83*d*, and 83*f* are provided in the inner circumferential surface of the internal gear 83*h*. In the example, the internal gear 83*h* is a member that is relatively fixed to the case 81 and does not rotate even when the output shaft 85 is rotated by the rotary shaft 82*a* of the motor 82. The sun gear 83*a*, the planetary gear 83*b*, the planetary carrier 83*c*, the planetary gear 83*d*, the planetary carrier 83*e*, the planetary gear 83*f*, and the planetary carrier 83*g* are housed inside the internal gear 83*h*.

The sun gear 83*a* is connected to the rotary shaft 82*a* of the motor 82 and rotates around the rotary shaft 82*a*.

The planetary gear 83*b* engages the sun gear 83*a* and rotates and revolves around the sun gear 83*a* as the sun gear 83*a* rotates.

The planetary carrier 83*c* engages the planetary gear 83*b* and rotates as the planetary gear 83*b* rotates.

The planetary carrier 83*c* is a sun gear that engages the planetary gear 83*d*. The planetary gear 83*d* rotates and revolves around the planetary carrier 83*c* as the planetary carrier 83*c* rotates.

The planetary carrier 83*e* engages the planetary gear 83*d* and rotates as the planetary gear 83*d* rotates.

The planetary carrier 83*e* is a sun gear that engages the planetary gear 83*f*. The planetary gear 83*f* rotates and revolves around the planetary carrier 83*e* as the planetary carrier 83*e* rotates.

The planetary carrier 83*g* engages the planetary gear 83*f* and rotates as the planetary gear 83*f* rotates.

The shaft part 84 is housed in the second case member 81*b* of the case 81 and is directly or indirectly connected with the planetary carrier 83*g*. The shaft part 84 rotates as the planetary carrier 83*g* rotates. The shaft part 84 may include, for example, a torque limiter.

At least a part of the output shaft 85 protrudes from the case 81. In the example, one end of the output shaft 85 protrudes from the second case member 81*b*; and the other end of the output shaft 85 is housed in the second case member 81*b* and connected with the shaft part 84. The output shaft 85 is rotatable with respect to the case 81 as the rotary shaft 82*a* of the motor 82 rotates. Thereby, the output shaft 85 outputs the rotational force of the motor 82 transmitted via the transmission mechanism 83 to the toilet seat 30 or the toilet lid 50. In other words, the electric opening/closing unit 80 opens and closes the toilet seat 30 or the toilet lid 50 by the rotation of the motor 82 transmitted to the output shaft 85.

The spring 86 is housed in the second case member 81*b* of the case 81. The spring 86 is, for example, a torsion coil spring. One end part of the spring 86 is connected to the transmission mechanism 83; and the other end part of the spring 86 is connected to the output shaft 85. The spring 86 urges the output shaft 85 in the rotational direction of the output shaft 85. That is, the elastic force of the spring 86 is transmitted to the toilet seat 30 or the toilet lid 50 via the output shaft 85. For example, the spring 86 urges the toilet seat 30 or the toilet lid 50 in the open direction. By providing the spring 86, the opening and closing of the toilet seat 30 and/or the toilet lid 50 can be assisted.

The shaft part 84 is located inside the spring 86. For example, the rotary shaft 82*a* of the motor 82, the planetary carriers (the sun gears) of the transmission mechanism 83, the shaft part 84, the output shaft 85, and the center axes (the rotation axes) of the spring 86 match each other. The center axes (the rotation axes) being matched may include not only cases where the center axis is positioned exactly on a straight line but also, for example, slight deviation within the range of manufacturing fluctuation, play in the design, etc. For example, the spring 86 is located not to contact the members (the case 81) outside the spring 86 and the members (the shaft part 84) inside the spring 86.

In the description of the embodiment, the direction in which the rotation axis extends is called the axial direction. The transmission of the rotation (the force) may include not only cases where a member directly transmits the force by direct contact but also cases where the force is indirectly transmitted via another member located between the members.

Figure 4:
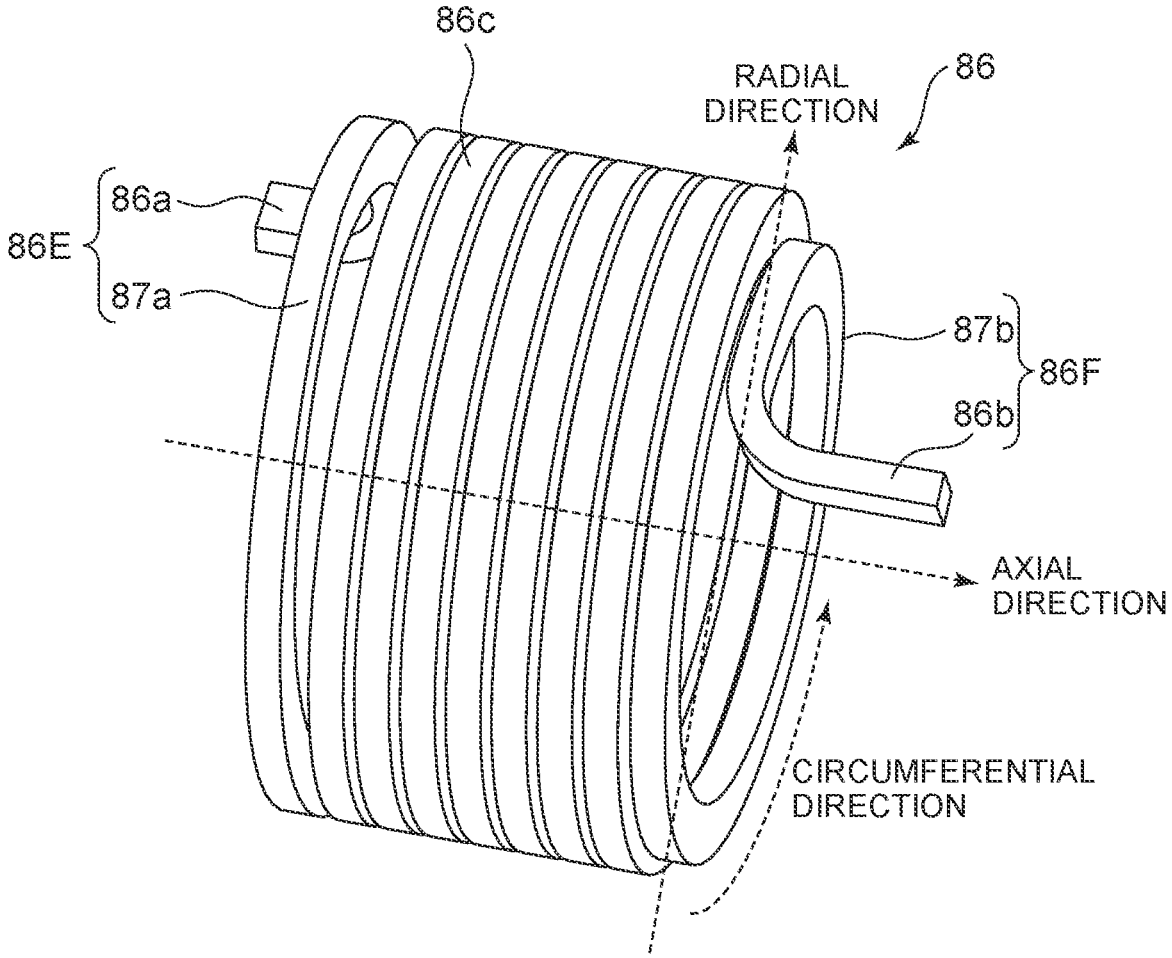
FIG. 4 is a perspective view illustrating the spring of the electric opening/closing unit according to the embodiment.

FIG. 4 is a perspective view illustrating the spring of the electric opening/closing unit according to the embodiment.

The spring 86 includes a first hook part 86*a*, a second hook part 86*b*, and a coil part 86*c*. The spring 86 is formed from a wire. The wire includes a material (e.g., steel, stainless steel or the like) that includes a metal such as iron, etc.

The coil part 86*c* is a part in which the wire is wound in a spiral shape. The first hook part 86*a* is a part that extends from one end of the coil part 86*c* along the axial direction toward the transmission mechanism 83 side. The second hook part 86*b* is a part that extends from the other end of the coil part 86*c* along the axial direction toward the output shaft 85 side.

The spring 86 is connected with the transmission mechanism 83 at an end part 86E of the spring 86. The end part 86E includes the first hook part 86*a*. The end part 86E may include an end part 87*a* of the coil part 86*c* at the transmission mechanism 83 side. For example, the end part 87*a* includes a range of not more than one wind of the spiral of the coil part 86*c* from the first hook part 86*a*. The end part 87*a* may include a range of not more than ½ of a wind or ¼ of a wind of the spiral of the coil part 86*c* from the first hook part 86*a*.

The spring 86 is connected with the output shaft 85 at an end part 86F of the spring 86. The end part 86F includes the second hook part 86*b*. The end part 86F may include an end part 87*b* of the coil part 86*c* at the output shaft 85 side. For example, the end part 87*b* includes a range of not more than one wind of the spiral of the coil part 86*c* from the second hook part 86*b*. The end part 87*b* may include a range of not more than ½ of a wind or ¼ of a wind of the spiral of the coil part 86*c* from the second hook part 86*b*.

Figure 5:
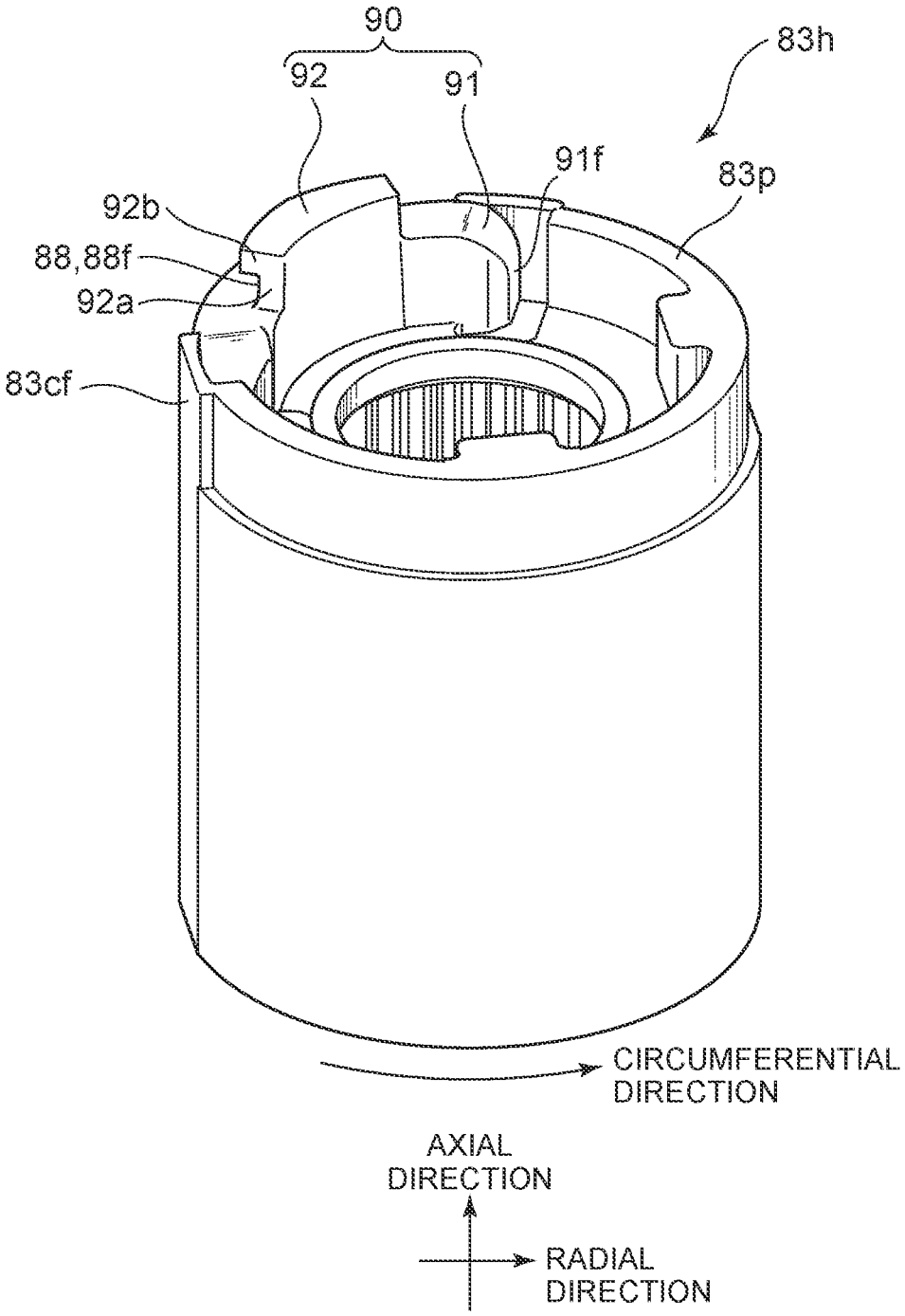
FIG. 5 is a perspective view illustrating a part of the transmission mechanism of the electric opening/closing unit according to the embodiment.
Figure 6:
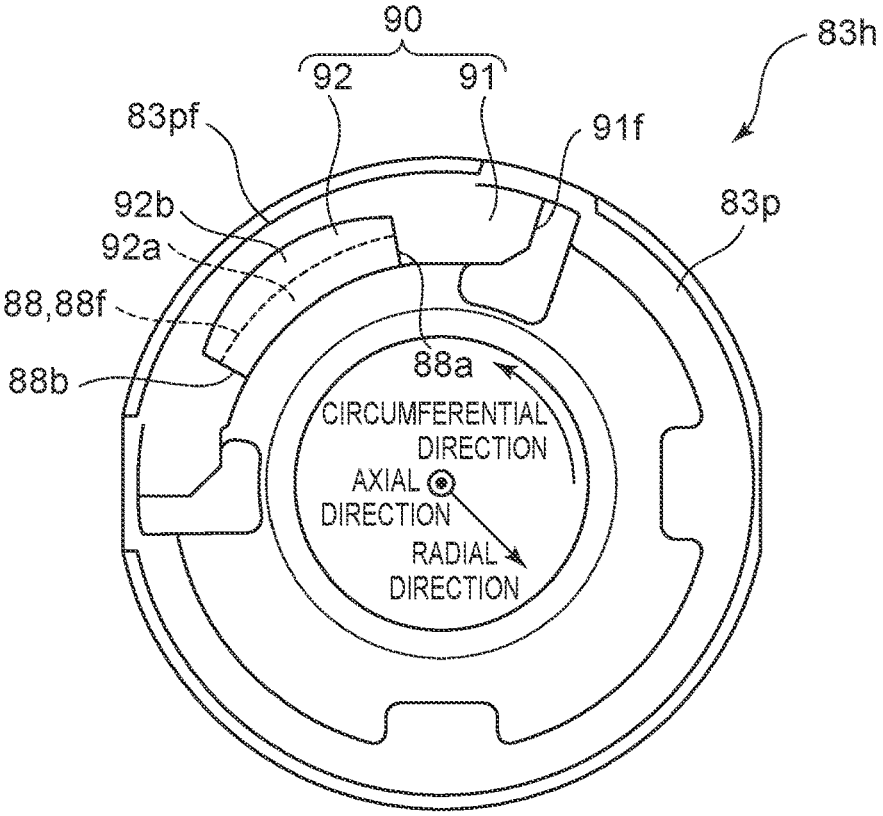
FIG. 6 is a plan view illustrating the part of the transmission mechanism of the electric opening/closing unit according to the embodiment.

FIG. 5 is a perspective view illustrating a part of the transmission mechanism of the electric opening/closing unit according to the embodiment. FIG. 6 is a plan view illustrating the part of the transmission mechanism of the electric opening/closing unit according to the embodiment. FIG. 5 illustrates the internal gear 83*h* of the transmission mechanism 83; and FIG. 6 illustrates the internal gear 83*h* when viewed along the axial direction.

For example, the transmission mechanism 83 latches on the end part of the spring 86 at the internal gear 83*h*. For example, as illustrated in FIGS. 5 and 6, the transmission mechanism 83 includes an engaging part 90 (a latch part) that engages the spring 86. The engaging part 90 is located at the end part of the internal gear 83*h* at the output shaft 85 side.

The engaging part 90 engages the end part 86E of the spring 86 and restricts the end part 86E from moving in the circumferential direction of the spring 86. Also, the engaging part 90 engages the end part 86E of the spring 86 and restricts a part of the spiral wire from moving in the radial direction of the spring 86. The circumferential direction is the rotational direction around the axial direction and is a direction along the circumference of the spiral of the coil part 86*c*. The radial direction is perpendicular to the axial direction and is a direction in which the radius of the circle of the spiral of the coil part 86*c* extends.

More specifically, in the example, the engaging part 90 includes a first regulating part 91 that restricts the movement in the circumferential direction of the spring 86, and a second regulating part 92 that restricts the movement of the spring 86 in the radial direction and the axial direction.

The first regulating part 91 is located at inner circumference of a tubular body 83*p* of the internal gear 83*h*. The first regulating part 91 includes a regulating surface 91*f* that restricts the movement in the circumferential direction of the spring 86. The regulating surface 91*f* extends along the axial direction and the radial direction and is substantially perpendicular to the circumferential direction. As described below with reference to FIG. 8, the regulating surface 91*f* engages the first hook part 86*a* and restricts the movement in the circumferential direction of the spring 86.

The second regulating part 92 is a protrusion that protrudes from the end part of the tubular body 83*p* of the internal gear 83*h*. More specifically, the second regulating part 92 includes a first part 92*a* and a second part 92*b*. The first part 92*a* extends in the axial direction from the tubular body 83*p*. As described below with reference to FIGS. 8 and 9, the first part 92*a* engages the end part 87*a* of the spring 86 and restricts the movement in the radial direction of the spring 86. The second part 92*b* is located at the end part of the first part 92*a* at the output shaft 85 side. The second part 92*b* extends outward in the radial direction when viewed from the first part 92*a*. As described below with reference to FIGS. 8 and 9, the second part 92*b* engages the end part 87*a* of the spring 86 and restricts the movement in the axial direction of the spring 86. For example, as illustrated in FIG. 6, the first part 92*a* and the second part 92*b* are positioned inward of an outer circumference side surface 83*pf* of the tubular body 83*p* in the radial direction.

Figure 7:
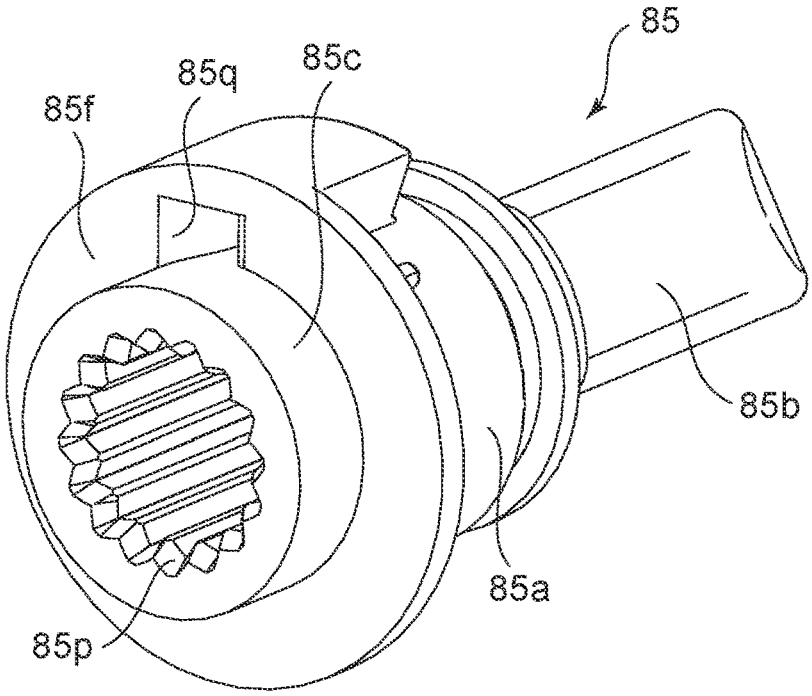
FIG. 7 is a perspective view illustrating the output shaft of the electric opening/closing unit according to the embodiment.

FIG. 7 is a perspective view illustrating the output shaft of the electric opening/closing unit according to the embodiment.

As illustrated in FIG. 7, one end of the output shaft 85 is, for example, a tubular part 85*a*. The shaft part 84 is inserted into an opening 85*p* of the tubular part 85*a*. Thereby, the output shaft 85 is connected with the shaft part 84. The other end of the output shaft 85 is, for example, a prismatic part 85*b*. For example, the prismatic part 85*b* is inserted into the toilet seat 30 or the toilet lid 50. Thereby, the output shaft 85 is connected with the toilet seat 30 or the toilet lid 50.

The output shaft 85 includes a flange part 85*f*. For example, the flange part 85*f* extends outward from the side surface of the tubular part 85*a*. The flange part 85*f* includes a hole 85*q* (an opening) extending in the axial direction. The second hook part 86*b* of the spring 86 is inserted into the hole 85*q*. Thereby, the spring 86 is connected with the output shaft 85. By engaging the second hook part 86*b* and the hole 85*q*, the elastic force of the spring 86 can urge the toilet seat 30 or the toilet lid 50 via the flange part 85*f* and the prismatic part 85*b*.

The output shaft 85 further includes a regulating part 85*c*. The regulating part 85*c* (a third regulating part) is a part that protrudes further toward the transmission mechanism 83 side than the flange part 85*f*. The regulating part 85*c* is positioned inward of the hole 85*q*. In the example, the regulating part 85*c* is a part of the tubular part 85*a* further toward the transmission mechanism 83 side than the flange part 85*f*. As described below with reference to FIG. 9, the regulating part 85*c* restricts the movement in the radial direction of the spring 86.

Figure 8:
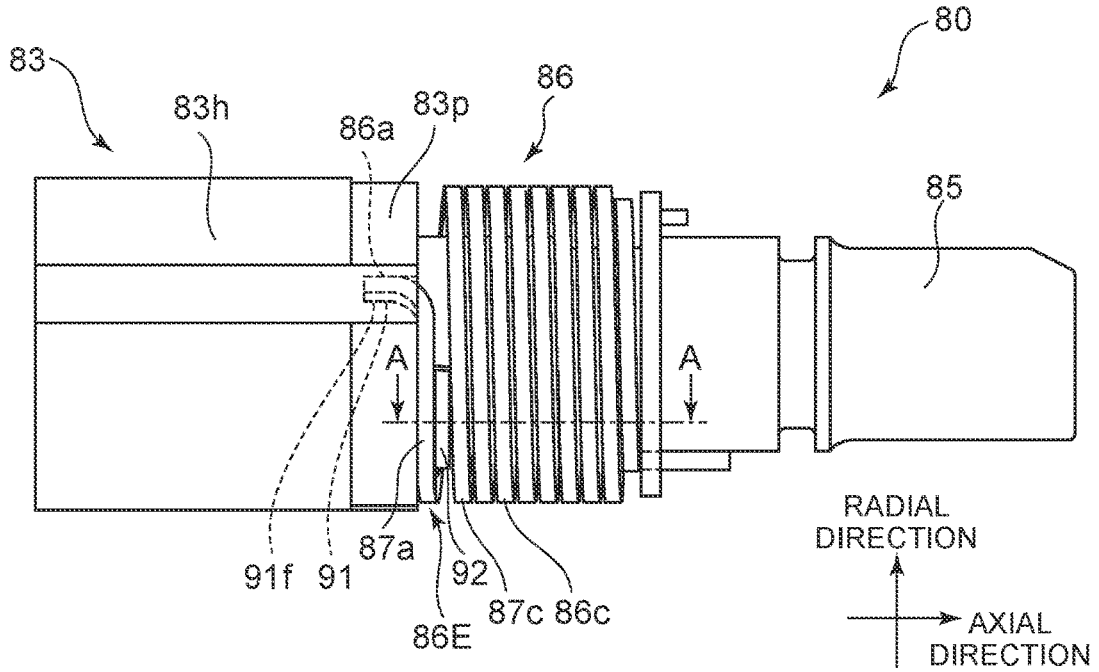
FIG. 8 is a plan view illustrating a part of the electric opening/closing unit according to the embodiment.

FIG. 8 is a plan view illustrating a part of the electric opening/closing unit according to the embodiment.

Figure 9:
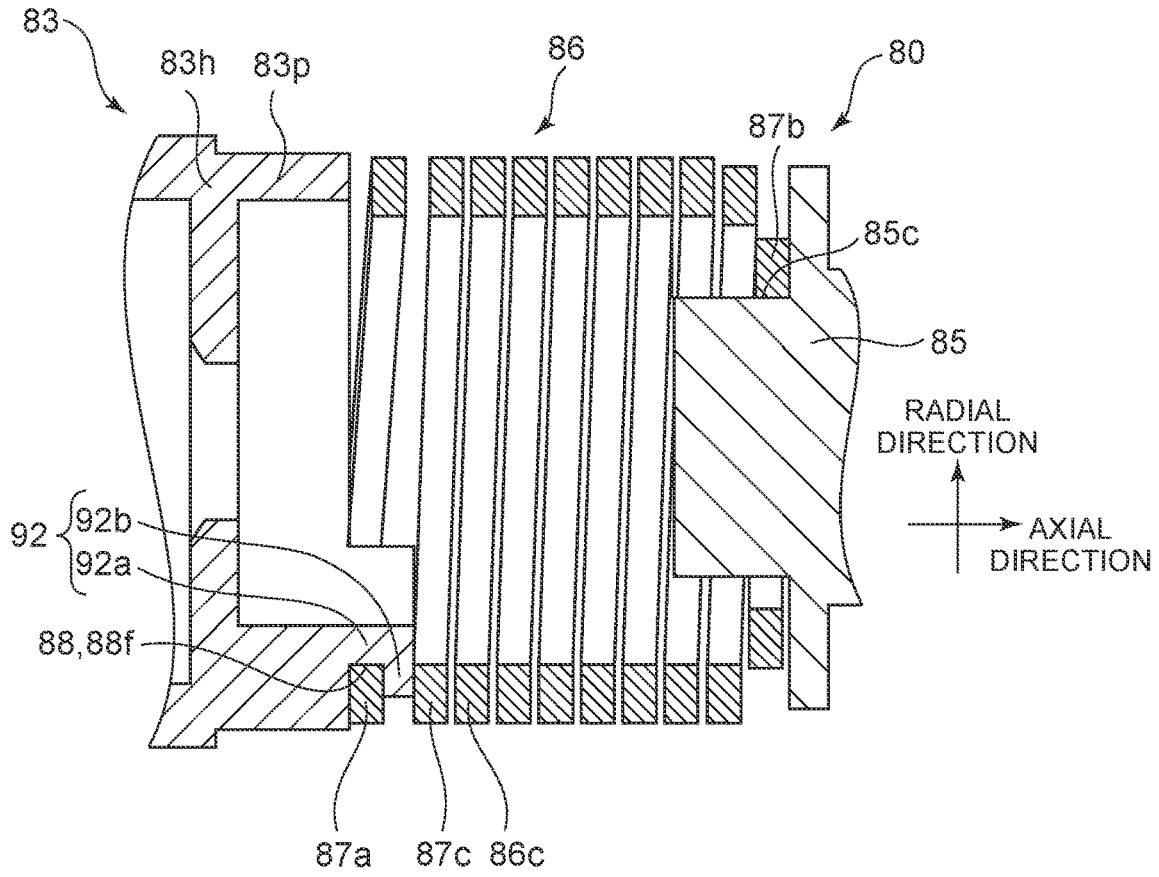
FIG. 9 is a cross-sectional view illustrating a part of the electric opening/closing unit according to the embodiment.

FIG. 9 is a cross-sectional view illustrating a part of the electric opening/closing unit according to the embodiment.

FIG. 8 illustrates the state in which the transmission mechanism 83, the spring 86, and the output shaft 85 are connected. FIG. 9 illustrates a cross section along line A-A illustrated in FIG. 8.

As illustrated in FIG. 8, the first hook part 86*a* of the spring end part is inserted into the inner circumference of the tubular body 83*p* of the internal gear 83*h*. Thereby, the first regulating part 91 of the engaging part 90 engages the first hook part 86*a* and restricts the movement in the circumferential direction of the spring 86. For example, the first hook part 86*a* contacts the regulating surface 91*f* in the circumferential direction. The movement in the circumferential direction of the first hook part 86*a* is stopped thereby, and the movement in the circumferential direction of the spring 86 is limited.

For example, as illustrated in FIGS. 8 and 9, the second regulating part 92 engages the end part 87*a* of the coil part 86*c* (a part of the spiral wire) and restricts the movement of the spring 86 in the axial direction and the radial direction. For example, the end part 87*a* of the coil part 86*c* contacts the second regulating part 92 in the radial direction (and the axial direction). The movement of the end part 87*a* in the radial direction (and the axial direction) is stopped thereby, and the movement of the spring 86 in the radial direction (and the axial direction) is limited.

As described above, the engaging part 90 that is included in the transmission mechanism 83 restricts the movement in the circumferential direction of the end part 86E of the spring 86. Thereby, the spring 86 can be torqued as the output shaft 85 rotates. Therefore, the spring 86 is wound and unwound. There are cases where the winding or unwinding of the spring 86 generates a force causing at least a part of the spring 86 to move in the radial direction of the spring 86. For example, there is a risk that a force causing the spring to become eccentric with respect to the output shaft 85, a force that deforms (bends) the spring 86 with respect to the axial direction of the spring 86, or a force that causes the spring 86 to obliquely tilt with respect to the output shaft 85 may be generated. When at least a part of the spring 86 moves in the radial direction, there is a risk that a frictional resistance (a sliding resistance) may be generated by contact between a part of the spring 86 and a part of the electric opening/closing unit. For example, there is a risk that frictional resistance due to contact between the spring 86 and the case 81 covering the spring 86, frictional resistance between the lines of the spring 86 (frictional resistance due to contact between adjacent parts of the spiral spring), frictional resistance due to contact between the spring 86 and the shaft part 84 positioned at the inner circumference of the spring 86, etc., may be generated. In contrast, according to the embodiment, the engaging part 90 that is included in the transmission mechanism 83 restricts the movement in the radial direction of a part of the wire of the spring 86; and the movement in the radial direction of the spring 86 can be suppressed thereby. Frictional resistance due to contact of a part of the spring 86 with a part of the electric opening/closing unit can be suppressed thereby.

Also, an abnormal noise is generated when the spring 86 is wound or unwound with a part of the spring 86 in contact with another part. In contrast, according to the embodiment, abnormal noise (sliding noise) can be suppressed because the contact of parts of the spring 86 with other parts can be suppressed.

For example, a method may be considered in which the reduction of the frictional resistance is accounted for by increasing the torque by thickening the wire, increasing the coil diameter, or increasing the initial torsion. Also, a method may be considered in which abnormal noise is prevented by providing a sufficient gap is provided between the wires and by coating the contact parts with a lubrication oil such as grease, etc. However, there are cases where such methods increase the spring size, and there is a risk that design constraints of the toilet device may arise. In contrast, according to the embodiment, enlargement of the spring can be suppressed because frictional resistance and/or abnormal noise can be suppressed as described above by the transmission mechanism 83 including the engaging part 90.

As illustrated in FIG. 9, the first part 92*a* of the second regulating part 92 is positioned inward of the coil part 86*c* and restricts the movement in the radial direction of a part of the wire of the spring 86. For example, the first part 92*a* limits the movement of the end part 87*a* toward the inside by contacting the end part 87*a* of the spring 86 in the radial direction of the spring 86.

As illustrated in FIG. 9, the second part 92*b* of the second regulating part 92 extends from the first part 92*a* outward from inside the coil part 86*c* and restricts the movement in the axial direction of a part of the wire of the spring 86. For example, the second part 92*b* contacts the end part 87*a* of the spring 86 in the axial direction of the spring. The second part 92*b* is sandwiched between adjacent parts (the end part 87*a* and another part 87*c*) of the wire of the spring 86.

As the spring 86 rotates, the spring 86 is wound and unwound and elongates and contracts in the axial direction. Therefore, there is a possibility that the contraction of the spring 86 may undesirably cause the spring 86 to detach from the transmission mechanism 83 and/or the output shaft 85. In contrast, according to the embodiment, because the engaging part 90 includes the second part 92*b*, the movement of the spring 86 in the axial direction can be suppressed even when the spring 86 contracts in the axial direction; and the detachment of the spring from the transmission mechanism and the output shaft can be suppressed.

The configuration of the engaging part 90 is not limited to the configuration described above; any shape or position may be used as long as the engaging part 90 engages the end part 86E of the spring 86 and can restrict the movement of the end part 86E in the circumferential direction and the radial direction. The configuration of the second regulating part 92 is not limited to the configuration described above; any shape or position may be used as long as the second regulating part 92 engages the end part 86E of the spring 86 and can restrict the movement of the end part 86E in at least the radial direction.

For example, a configuration may be used in which the first part that restricts the movement in the radial direction of the spring 86 is located outward of the coil part, and the second part that restricts the movement in the axial direction extends inward from outside the coil part. However, in such a case, at least a part of the latch part is located outside the spring, and the inner diameter of the case is increased commensurately, which may cause enlargement of the electric opening/closing unit. In contrast, in the example of FIG. 9, the first part 92*a* is positioned inside the coil part 86*c*; and the second part 92*b* extends from the first part 92*a* outward from inside the coil part 86*c*. The increase of the inner diameter of the case 81 can be suppressed thereby, and the space inside the spring 86 can be effectively used. Also, contact of the spring 86 with components located inside the spring 86 can be suppressed when the diameter of the spring 86 is reduced by winding the spring 86.

For example, the first part 92*a* includes an arc-like part 88 along the inner circumference of the coil part 86*c* (see FIG. 5, FIG. 6, and FIG. 9). Specifically, at least an outer side surface 88*f* of the first part 92*a* is arc-like when viewed along the axial direction, and has a shape along the inner circumferential surface of the spiral coil part 86*c*. Thereby, for example, the first part 92*a* can have surface contact with the coil part 86*c*. In the example, the entire first part 92*a* is formed in an arc-like shape when viewed along the axial direction.

As illustrated in FIG. 6, a part of the second part 92*b* extends along the circumferential direction from one end 88*a* in the circumferential direction of the arc-like part 88 of the first part 92*a* to another end 88*b* in the circumferential direction of the arc-like part 88. The contact area between the engaging part 90 and the spring 86 can be increased thereby, and the forces that are applied to the engaging part 90 and tend to move the spring 86 in the radial direction and the axial direction can be dispersed. Thereby, while improving the durability of the engaging part 90, for example, the reduction of the spring torque due to frictional resistance due to contact between the spring 86 and the case 81 can be suppressed, and abnormal noise (sliding noise) due to the contact can be suppressed.

As illustrated in FIG. 9, the regulating part 85*c* of the output shaft 85 at the output shaft 85 side of the spring 86 is positioned inside the coil part 86*c*. The regulating part 85*c* is arranged with the end part 87*b* of the coil part 86*c* in the radial direction and contacts, for example, the end part 87*b*. The movement of the end part 87*b* in the radial direction (inward) is stopped thereby, and the movement in the radial direction of the spring 86 is limited.

According to the embodiment as described above, the movement in the radial direction of the spring 86 can be suppressed by providing the engaging part 90 that engages the end part at the transmission mechanism 83 side of the spring 86. On the other hand, there are cases where a force that causes the spring 86 to move in the radial direction is transmitted through the spring and undesirably causes the spring 86 at the output shaft 85 side to move in the radial direction. In contrast, by including the regulating part 85*c* in the output shaft 85, the movement in the radial direction of the spring 86 can be suppressed even at the output shaft 85 side of the spring 86. For example, the reduction of the spring torque due to frictional resistance due to contact between the spring 86 and the case 81 can be suppressed thereby, and abnormal noise (sliding noise) due to the contact can be suppressed.

The configuration of the regulating part 85*c* is not limited to the configuration described above; any shape or position may be used as long as the regulating part 85*c* engages the end part 86F of the spring 86 and can restrict the movement in the radial direction of the end part 86F. For example, the regulating part 85*c* may have a hook shape and may be located outside the coil part 86*c*. However, in the examples of FIG. 9, etc., compared to when a regulating part is located outside the coil part 86*c*, the enlargement of the case 81 can be suppressed because the space inside the spring 86 can be effectively used by positioning the regulating part 85*c* inside the coil part 86*c*.

The invention has been described with reference to the embodiments. However, the invention is not limited to these embodiments. Any design changes in the above embodiments suitably made by those skilled in the art are also encompassed within the scope of the invention as long as they fall within the spirit of the invention. For example, the shape, the size the material, the disposition and the arrangement or the like of the components included in the toilet device are not limited to illustrations and can be changed appropriately.

The components included in the embodiments described above can be combined to the extent possible, and these combinations are also encompassed within the scope of the invention as long as they include the features of the invention.

What is claimed is:

1. A toilet device, comprising:

an electric opening/closing unit configured to open and close at least one of a toilet seat or a toilet lid, the electric opening/closing unit including a case, a motor housed in the case, an output shaft outputting a rotation of the motor to one of the toilet seat or the toilet lid, at least a part of the output shaft protruding from the case, a transmission mechanism housed in the case, the transmission mechanism transmitting the rotation of the motor to the output shaft, and a spring housed in the case and connected to the transmission mechanism and the output shaft, the spring including a coil part including a wire wound into a spiral shape, the spring urging the output shaft in a rotational direction of the output shaft, the transmission mechanism including an engaging part engaging the spring, the engaging part engaging an end part of the spring at the transmission mechanism side and restricting the end part from moving in a circumferential direction of the spring and from moving in a radial direction of the spring.

2. The device according to claim 1, wherein the engaging part includes:

a first part positioned inside the coil part, the first part restricting a movement of a part of the spiral wire in the radial direction; and a second part extending from the first part outward from inside the coil part, the second part restricting a movement of the part of the wire in an axial direction.

3. The device according to claim 2, wherein the first part includes an arc-like part along an inner circumference of the coil part, and a part of the second part extends from one end in the circumferential direction of the arc-like part to an other end in the circumferential direction of the arc-like part.

4. The device according to claim 1, wherein the output shaft includes a regulating part restricting a movement of the spring in the radial direction, and the regulating part is positioned inside the coil part.

* * * * *